United States Patent [19]

Tripp

[11] Patent Number: 4,948,023

[45] Date of Patent: Aug. 14, 1990

[54] FLUID STORING AND SUPPLY MEANS

[76] Inventor: Gordon R. Tripp, 40 Piedmont Road, Sherwood, Durban, Natal Province, South Africa

[21] Appl. No.: 278,815

[22] Filed: Dec. 2, 1988

[30] Foreign Application Priority Data

Dec. 7, 1987 [ZA] South Africa ..... 87/9158

[51] Int. Cl.[5] ..... A45F 3/16

[52] U.S. Cl. ..... 224/148; 222/175; 222/209

[58] Field of Search ..... 224/148, 202, 204, 209, 224/214, 215, 228, 254, 259, 260; 222/175, 183, 215; 441/112, 113

[56] References Cited

U.S. PATENT DOCUMENTS

| | | | |
|---|---|---|---|
| 4,090,650 | 5/1978 | Gotta | 224/148 |
| 4,139,130 | 2/1979 | Glusker et al. | 224/148 |
| 4,176,772 | 12/1979 | Danon | 224/148 |
| 4,265,381 | 5/1981 | Muscatell | 224/148 |
| 4,420,097 | 12/1983 | Motsenbocker | 222/215 X |
| 4,544,087 | 10/1985 | Modig | 224/148 |
| 4,627,554 | 12/1986 | Libinsohn | 224/148 X |

*Primary Examiner*—Ernest G. Cusick

*Attorney, Agent, or Firm*—Curtis, Morris & Safford

[57] ABSTRACT

A fluid storing and supply device includes two fluid containers supported within outer pouches and a conduit extending from each fluid container through which liquid contained in the containers can be consumed. A harnessing arrangement for harnessing the device to the body of a person which includes straps of predetermined length whereby the pouches can be suspended on a person's rib cage with one pouch abutting the person's chest and the other pouch abutting the person's back. Further straps permit tying of the positioned pouches to the rib cage in a manner that the pouches bear upon the rib cage so that a substantial part of the pressure exerted by the weight of fluid stored in the fluid containers is distributed over the surface area of the rib cage borne upon by the pouches and the harnessing arrangement.

19 Claims, 2 Drawing Sheets

FLUID STORING AND SUPPLY MEANS

FIELD OF THE INVENTION

This invention relates to a fluid storing and supply means for use by individuals. More particularly, but not specifically, the invention relates to a fluid storing and supply means for use by athletes, sportmen and workmen, who may require intakes of fluid while actively involved in their pursuits.

BRIEF DESCRIPTION OF THE PRIOR ART

A loss of body fluids, particularly water, accompanies almost all forms of physical activity, from walking and general recreation to vigorous exercising, labor and sports. Replenishment of body fluids during outdoor activity is therefore extremely important for maintaining the activity at a reasonably high performance level and with as little exhaustion as possible arising from dehydration.

Portable fluid dispenser means are known in the prior art. Some portable fluid dispensers are strapped to an individuals person and allow him to drink fluids when it may not be otherwise convenient to stop the activity which he is engaged in. Use of prior art fluid dispensers is cumbersome, some are distracting and dangerous to the individual when engaged in vigorous activity and others tend to cause the fluid dispenser to be irregularly displaced when attached to the body, causing discomfort and disorientation.

Conventional harnessing arrangements for personal fluid dispensers provide for fluid dispensers which can be (a) suspended from the shoulders, either in a knapsack type configuration or with the fluid storing means disposed adjacent to the stomach; or (b) tied to the stomach.

Suspension of the fluid storing means from the shoulders may be a satisfactory means of supporting the fluid storing means during comparatively leisurely activity. However, such a means of suspension is far from satisfactory during vigorous activity. The shoulder straps bear down upon the bursa, the deltoid muscles and the clavicle and also cause compression of the tissues associated with the neck and the shoulders. This pressure restricts blood flow and may also cause pressure on the nerves leading to the upper limbs. Friction between the straps and the skin because of continuous movement of the bursa, deltoid, trapezia and the splenius muscles in this region, as a result of vigorous exercise, causes intense chafing of the skin which is positively irritating, often leading to bursitis.

Attempts have been made to attend to this chafing. For instance, shoulder pads have been provided between the straps and the skin. These pads have proved unsatisfactory. They do not position well on the shoulders, are displaceable and in many instances merely transfer the point of chafing.

Waist supported fluid dispensers are usually in the form of flexible belts tied around the waist and are supported by the protuberances on the waist caused by the ileus of the hip bone.

Again in vigorous exercice, such as canoeing and long distance running, waist-supported fluid dispensers or fluid dispensers that are disposed on the stomach, obstruct the free movement of the external oblique muscles and the rectus abdominus of the abdomen. Obstruction to the muscles restricts proper breathing.

Several prior art patents disclose fluid dispensers. For example:

Wooten, U.S. Pat. No. 3,348,741 discloses a dispenser apparatus that is capable of being carried by a user. It comprises an arcuate tank fitted with straps for attachment on the back of a user. Dispensing of fluid is done by an auxiliary pressurised tank;

Kassel, U.S. Pat. No. 2,558,181, discloses a portable device having an inner tank and an outer casing. Dispensing of liquid is done by means of a pressure head;

Osborne, U.S. Pat. No. 2,013,358, discloses a knapsack containing a water bag conforming to the internal contour of the knapsack. Two separate openings are required, one for filling the bag and one for dispensing;

Motsenbocker, U.S. Pat. No. 4,420,097, discloses a portable liquid dispenser with a carrying case which is thin and pillow shaped, but is suspended from the body;

Gotta, U.S. Pat. No. 4,090,650, discloses a canteen provided with a drinking straw which is tied to the waist by a belt;

Eger, U.S. Pat. No. 4,629,098, discloses a portable liquid dispenser which requires a flexible bulb for creating pressure within the dispenser for dispensing liquid;

Janus Ronald, W.O. Patent No. 87/02873, discloses a fluid access means which is securable to a user's neck and requires the insertion of a straw;

Modig Ronald, U.S. Pat. No. 4,544,087, discloses a portable fluid holder having exchangeable plastics bags. Non-return valve means are required to prevent air from entering the bags during the drinking process; and Boxer, U.S. Pat. No. 4,526,298, discloses a hydrating system mounted on a suspension system having elastic straps. The entire weight of the suspension is centralized at an anatomical pivotal point in the small of the back. The system also requires two openings for filling and dispensing.

The prior art in general, all these patents in particular, disclose fluid dispenser means having fluid storing means suspended, in use, from the body of a person, usually the shoulders, therefore creating pressure points on the body where the fluid storing means is suspended and/or allowing the fluid contents of the fluid storing means to be irregularly displaced. This can clearly cause a lot of discomfort.

SUMMARY OF THE INVENTION

In view of the foregoing, it is the aim of the invention to achieve the following objects jointly, severally, or in combination:

to provide a fluid storing and supply means from which an individual can draw desired quantities of fluid from the fluid storing means by applying suction at the supply means;

to provide a convenient fluid storing and supply means in which fluid can be retained at a desired temperature over extended periods of time;

to provide a fluid storing and supply means that is light, inexpensive and does not interfere with the activity being performed by an individual; and to provide an attachment system for a fluid storing and supply means that distributes the weight and mass of the fluid stored along or across a broad surface area of the body, thereby reducing the pressure per unit surface area, preventing irregular displacement of the contents of the fluid stored and eliminating pressure points.

In furtherance of the aforesaid and other objects of the invention there is provided, in accordance with this invention, a fluid storing and supply means, which includes two flexible fluid storing means defining an outer peripheral seam and walls;

at least one fluid supply means comprising an elongate fluid conduit extending from an operative lowest level of the fluid storing means; and harnessing means, being elongate elements secured near the outer peripheral seam of the fluid storing means for harnessing and abutting the fluid storing means with the rib cage of an individual so that the seam and abutting walls of the fluid storing means substantially contour and bear upon the rib cage.

The fluid storing means may include an inner fluid container in which fluid can be contained and an outer pouch in which the fluid container is held, which defines the outer seam of the fluid storing means. The inner fluid container may be made of a synthetic plastic fluid impervious and non-toxic material and the outer pouch may be of a natural or synthetic textile material which, in accordance with a preferred embodiment of this invention, is of a thermal insulating material. Alternatively, at least one layer of thermal insulating material may be disposed between the inner fluid container and the outer pouch. The outer peripheral seam of the fluid storing means may be defined by a seam running along the sides of the outer pouch, which may be a seam joining walls of the outer pouch together, or may be a reinforcing seam.

The fluid contained in the fluid storing means may be a variety of liquids including water and beverages and may further include liquids having their dissolved gases removed before filling the fluid storing means with the fluid.

The inner fluid container and the outer pouch may be integral. Alternatively, the inner fluid container may be secured to the outer pouch. Still alternatively, the inner fluid container may be releasably suspended within the outer pouch, the location of suspension being at the top of the fluid storing means. Therefore, in an operative configuration of the fluid storing means, attached to the body of an individual, the force of gravity acts on the fluid in the inner fluid container directing it downwards towards a discharge opening in the inner fluid container.

The fluid supply means may include at least one elongate conduit made of a resilient non-toxic material such as natural latex rubber, one end of which extends through an outer pouch of each of the fluid storing means and is located at an operative lowest level of the fluid storing means. The elongate conduit may be an elongate tubular element. One end of the elongate conduit may be welded to the discharge opening of the inner fluid container, the opening being located at an operative lowest level of the inner fluid container, therefore allowing drawing of fluid from the sump of the inner fluid container. Alternatively, the inner fluid container of the fluid storing means and the elongate conduit of the fluid supply means may be integral.

The elongate conduit may have a free end which is accessible to the mouth of an individual having the fluid storing and supply means attached on the rib cage of his body. The elongate conduit may be releasably attached along its length to the or any of the fluid storing means. A closure clamp may be attached to each of the fluid supply means, for permitting or restricting the flow of fluid through the fluid supply means.

The fluid storing and supply means may be attached to a body region of an individual in the particular configuration as described herein, by means of elongate elements secured to the fluid storing means and particularly, the outer pouch of the fluid storing means.

Preferably, a plurality of such elongate elements, in the nature of flexible straps, may be secured to the outer peripheral edge of the fluid storing means and may be passed around the body of the individual and may be fastened to one another by, for example, tying. The elongate elements may be made of soft webbing of non-elastic, natural or synthetic, textile material and may be secured at the four corners of the outer peripheral seam of the walls of fluid storing means, which define a generally rectangular configuration. Where two fluid storing means are provided, one or more of the elongate elements may be common to both the fluid storing means.

BRIEF DESCRIPTION OF THE DRAWINGS

An embodiment of the invention is now described, with reference to the accompanying drawings, in which.

DESCRIPTION OF THE PREFERRED EMBODIMENT

Figure 1:
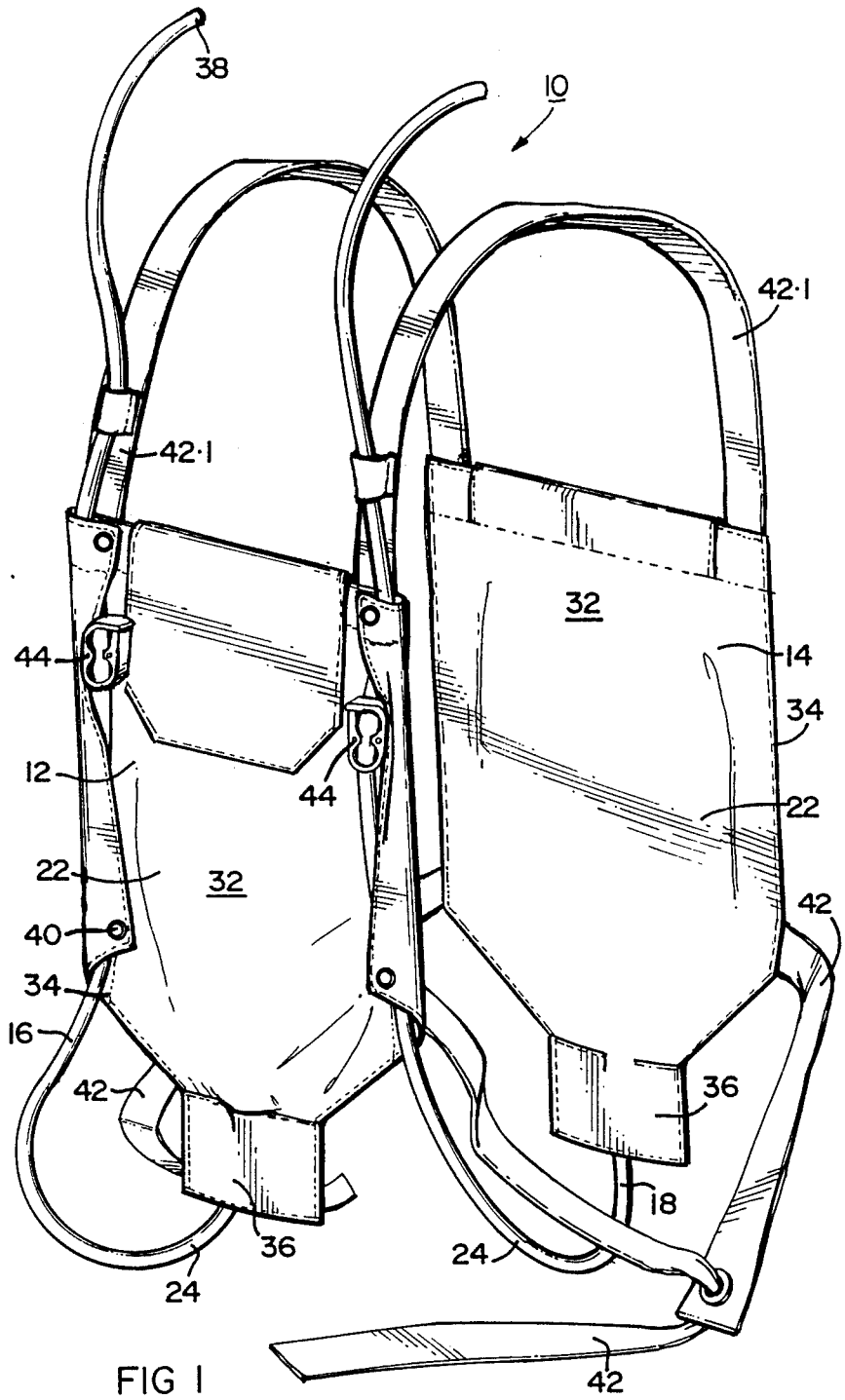
FIG. 1 is an isometric view of a fluid storing and supply means, in accordance with this invention.

Referring to the drawings, a fluid storing and supply means, in accordance with this invention is indicated generally by the reference numeral 10.

The fluid storing and supply means 10 includes two fluid storing means, 12 and 14. Each of the two fluid storing means, 12 and 14, have fluid supply means, generally indicated by 16 and 18, extending through a wall of each of the fluid storing means, 12 and 14.

Figure 2:
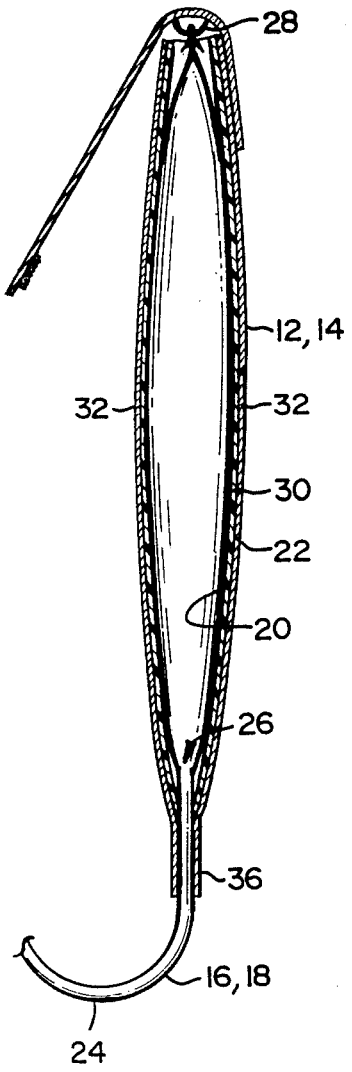
FIG. 2 is an enlarged cross-sectional side view of the fluid-storing and supply means of FIG. 1.

Each of the fluid storing means, 12 and 14, includes an inner drip bag type fluid container 20, as illustrated in FIG. 2, in which a fluid can be contained, and an outer pouch 22, in which the fluid container 20 is suspended. The fluid containers are made of a non-toxic, fluid impervious, food grade natural or synthetic plastic material. The inner fluid containers 20 are made by seam welding planar sheet elements around their periphery so that when the inner fluid containers are filled with a fluid, there is equal pressure exerted all around the seams. At the lowest level of each inner fluid container 20 in their in use configuration, a discharge opening 26 is provided to which a fluid supply conduit 24 is welded to form a leak-proof joint between the inner fluid container 20 and the fluid supply conduit 24.

Each inner fluid container 20 is releasably suspended from its pouch 22 by means of suspending formations 28 on the inner top edge of the pouch 22. The suspending formations 28 are laces tied into an eyelet located on each inner fluid container 20.

By suspending the inner fluid containers 20 within the pouches 22 as described, when the inner fluid containers are filled with liquids they will not tend to sag into the bottom of the pouches, which can occur if not so suspended. As such, the liquid bodies defined within the fluid containers will remain in a relatively flat form in which liquid movement is minimized and carrying comfort is enhanced, as is described in more detail hereinafter.

Each outer pouch 22 is of a natural or synthetic textile material which is thermally insulating. At least one layer of thermally insulating material 30 is also disposed between each inner fluid container 20 and its outer pouch 22. The outer pouch 22 defines walls 32 and a peripheral seam 34 as illustrated in FIG. 1, represented by a stitching seam. Each outer pouch 22 is provided with a neck opening 36 through which the conduit 24 can extend, from the inner fluid container 20 to the outside.

The fluid supply means, 16 and 18, comprise the elongate conduits 24, made of a resilient, non-toxic, material such as natural latex rubber, as seen earlier, an end of each of the conduits extending through the neck opening 36 of the outer pouch 22 and extending further to a free end 38, which is accessible to the mouth of an individual (not shown). Each elongate conduit 24 may be releasably attached along its length to holding formations 40 on one outer pouch 22 of the fluid storing means. A closure clamp 44 is attached to each of the conduits 24 for permitting or restricting the flow of fluid through the fluid supply means 16 and 18.

Elongate elements in the nature of straps 42 are secured to the peripheral seam 34 of each one of the outer pouches 22 of the fluid storing means, 12 and 14.

The straps 42 are secured by stitching at the four corners of the outer peripheral seam 34 of each of the pouches 22. The straps 42 are common to both pouches 22, extending from one to the other.

Fluid is filled into each inner fluid container 20 through the elongate conduit 24 by using a funnel attachment (not shown) at the free end 38 and feeding the fluid in by gravity. Alternatively, fluid may be pumped into the inner fluid container 20 through the elongate conduits 24. A variety of potable liquids, including water and beverages, may be filled in the inner fluid container, which should not have dissolved gasses, in practice.

The fluid storing and supply means can be attached on the rib cage an individual (not shown) by means of the fastening straps 42 so that the fluid storing means 12 and 14 abut a part of rib cage. For this mode of attachment, the straps 42.1 will pass over the shoulders of a user, whereas the other straps 42 will pass around the user's body, tying of these straps to one another taking place in a manner that tension is applied simultaneously to the pouches 22 via their seams in both vertical and horizontal directions. The straps 42 direct vectoral forces along the seams 34. This, in turn, causes the fluid storing means 12 and 14, to substantially contour and bear upon the rib cage, thereby effectively distributing the pressure exerted by the weight of the fluid in the fluid storing means from the shoulders to a surface area of the body approximately equal to the wall surface of the fluid storing containers bearing upon the rib cage means. The pressure exerted by the weight of the fluid load on the body of the individual is, therefore, evenly distributed over the rib cage and the fluid storing means, with its contents, becomes effectively contiguous with the body region. The complete load of the fluids in the containers will thus no longer be carried by the user's shoulders. The use of soft-webbed material for the straps 42 prevents chafing at the part of the body region to which the fluid storing and supply means 10 is attached. Thus, no pressure points are created anywhere on the body surface. The effective tension applied to the outer pouches 22, when harnessing the fluid storing and supply means 10 onto the body of a user, also reduces or prevents bulging of the containers 20 when filled with liquids, thus maintaining relatively thin liquid bodies within the containers. This greatly enhances the comfort of wearing the means 10 and reduces the effect of having a large mass or masses suspended from the body.

The individual desiring fluid and particularly a liquid sucks at the end 38 of a supply conduit 24, after releasing the clamp 44. Slight suction at the end 38, causes fluid to be drawn into the mouth of the individual. As is clearly illustrated, the conduit 24 is connected to a discharge opening 22, of the inner fluid container 20. Liquid is drawn into the mouth only by suction. Any excess liquid drawn falls back into the conduit. As liquid is drawn, very little or no air is passed back into the inner fluid container 20. Draining of liquid collapses the walls of the inner fluid container until no liquid is left. Use of this method of supplying liquid prevents the supply of liquid at a rate superior to gravity, or suction induced flow rates. Any amount fed, more than demanded by suction, will lead to choking, particularly when breathing hard during exertion.

By providing two fluid containers 20, different liquids can be carried and, in this way, the user's specific requirements can be accommodated.

I claim:

1. A fluid storing and supply means, which comprises:

two fluid storing means of flexible material, each fluid storing means defining an outer pouch defined by two opposing walls and an outer peripheral edge along the edge of said walls, and an inner fluid container suspended from the outer pouch;

harnessing means in the form of elongate flexible elements secured to the two outer pouches near the outer peripheral edges thereof, at least one elongate flexible element permitting the outer pouches to be suspended from a person's shoulders and be disposed on the chest and on the opposite upper back of the person and at least two elongate flexible elements permitting tightening of the outer pouches around the person's chest and opposite upper back and causing simultaneous outward tensioning of the walls of the outer pouches, causing the walls abutting the person's body to conform to the shape of said chest and upper back; and an elongate fluid conduit extending from the operative lowest level of each outer pouch when harnessed on a person's body, being sufficiently long to reach the person's mouth to permit the consumption of fluid contained within said inner fluid container.

2. A fluid storing and supply means as claimed in claim 1, in which each inner fluid container is of a synthetic plastic, fluid impervious, non-toxic material.

3. A fluid storing and supply means as claimed in claim 1, in which each inner fluid container is releasably suspended within the outer pouch.

4. A fluid storing and supply means as claimed in claim 1, in which each outer pouch has opposing walls joined together by an outer peripheral seam, constituting the outer peripheral edge of the fluid storing means.

5. A fluid storing and supply means as claimed in claim 1, in which each outer pouch is of a natural or synthetic textile material.

6. A fluid storing and supply means as claimed in claim 1, in which each outer pouch is of a thermally insulating material.

7. A fluid storing and supply means as claimed in claim 1, in which each fluid storing means includes a layer of a thermally insulating material transposed between the inner fluid container and the outer pouch.

8. A fluid storing and supply means as claimed in claim 1, in which the elongate fluid conduits include elongate tubular elements, one end of each element extending through a wall of its associated fluid storing means.

9. A fluid storing and supply means as claimed in claim 1, in which the elongate fluid conduits are of a resilient material.

10. A fluid storing and supply means as claimed in claim 9, in which the elongate fluid conduits are of natural latex rubber.

11. A fluid storing and supply means as claimed in claim 1 in which the elongate fluid conduits are of a non-toxic material.

12. A fluid storing and supply means as claimed in claim 1, in which the elongate fluid conduits are releasably attached at one end thereof to the outside of the outer pouches and are accessible to the mouth of a person at the opposite free end thereof.

13. A fluid storing and supply means as claimed in claim 1, which includes a closure clamp attached to each elongate fluid conduit for permitting and restricting the flow of fluid through the fluid conduit.

14. A fluid storing and supply means as claimed in claim 1, in which the opposing walls of the outer pouch define a generally rectangular configuration and four corners and the harnessing means includes two elongated flexible elements for the suspension of the outer pouches from a person's shoulders, all the elongate flexible elements of the harnessing means being secured to the respective outer pouches near the said four corners.

15. A fluid storing and supply means as claimed in claim 14, in which the elongate elements permitting tightening around a person's chest and opposing upper back include two elongate elements extending from operatively lower regions of the outer pouches.

16. A fluid storing and supply means as claimed in claim 14, in which the elongate flexible elements are elongate flexible straps.

17. A fluid storing and supply means as claimed in claim 16, in which the elongate flexible elements are made of soft webbing.

18. A fluid storing and supply means as claimed in claim 14, in which the two elongate flexible elements permitting the fluid storing means to be suspended from a person's shoulders extend between the two fluid storing means from locations near the operative upper corners of the fluid storing means, when suspended.

19. A fluid storing and supply means as claimed in claim 1, in which each fluid container defines a discharge opening and the elongate fluid conduits are connected in communication with the said discharge opening.

* * * * *